US005621269A

United States Patent [19]

Jang

[11] Patent Number: 5,621,269

[45] Date of Patent: Apr. 15, 1997

[54] CATHODE ASSEMBLY OF A MAGNETRON

[75] Inventor: Young K. Jang, Kumi, Rep. of Korea

[73] Assignee: Goldstar Co., Ltd., Seoul, Rep. of Korea

[21] Appl. No.: 378,092

[22] Filed: Jan. 25, 1995

Related U.S. Application Data

[63] Continuation of Ser. No. 987,173, Dec. 8, 1992, abandoned.

[30] Foreign Application Priority Data

Dec. 12, 1991 [KR] Rep. of Korea ..... 22804/1991

[51] Int. Cl.[6] ..... H01J 1/15; H01B 17/26

[52] U.S. Cl. ..... 313/326; 313/341; 174/151

[58] Field of Search ..... 174/151, 50.57, 174/50.58, 50.6, 50.63; 313/240, 326, 313, 333, 341, 560, 317, 318, 331; 333/86; 315/39.51

[56] References Cited

U.S. PATENT DOCUMENTS 3,479,442 11/1969 Detro ..... 174/50.58
4,558,250 12/1985 Tsuzurabara ..... 313/341
4,783,595 11/1988 Seidle ..... 250/423 R

*Primary Examiner*—Hyung S. Sough
*Attorney, Agent, or Firm*—Fish & Richardson P.C.

[57] ABSTRACT

A cathode assembly for a magnetron having a lower end shield for supporting a filament joined thereto and an insulator supporting a lower end shield on which the filament is mounted, the insulator being bonded to the lower surface of a flange on the lower end shield utilizing a ring shaped metalizing portion at the upper surface of the insulator which also joins a side lead to the lower end shield, and the insulator being fixedly mounted in a lower magnetic pole to exactly center the assembly about the central axis of an anode cylinder, thereby minimizing the quantity of dark current generated by escaping thermions, resulting in an enhanced efficiency of the magnetron.

5 Claims, 5 Drawing Sheets

CATHODE ASSEMBLY OF A MAGNETRON

This application is a continuation of U.S. application Ser. No. 07/987,173, filed Dec. 8, 1992, now abandoned.

BACKGROUND OF THE INVENTION

1. Field of the Invention

This invention concerns a lower end shield assembly of a magnetron. The assembly can be mounted in a microwave oven, sometimes referred to as an electronic range, to generate microwaves. The lower end shield is of an improved construction and is capable of reducing dark current. Dark current is current that does not contribute to the oscillation of the magnetron.

2. Description of the Prior Art

Generally, a magnetron is a type of diode which is used for efficiently producing microwaves. A magnetron is usually mounted to a microwave oven which is used for heating and thawing of food items. As shown in FIG. 1 of the accompanying drawings, a magnetron for a microwave oven comprises an anode cylinder 1 provided on its inner periphery with a plurality of radially extending vanes 3, and a direct-heated filament (referred to as a cathode) 2 disposed axially in a centered relation within the anode cylinder.

In addition, the magnetron includes a magnetic circuit comprising upper and lower magnets 5, 6, upper and lower plates 7, 8, and upper and lower magnetic poles 9, 10. An output section comprises an antenna 11, an antenna ceramic 12, an exhaust pipe 13 and an antenna cap 14.

When the filament 2 is energized, thermions are emitted from the filament into an active space 4, which is defined between the filament 2 and the vanes 3 of the anode cylinder. The emitted thermions effect cycloidal movement by virtue of an electric field induced between the filament and the vanes and a magnetic flux applied within the space by the magnetic circuit, thereby applying energy to the vanes to generate microwaves. Microwaves are then emitted through the output section to the exterior of the magnetron and radiated into the cavity of the microwave oven via a waveguide to heat or thaw the food items placed within the oven.

A filter circuit comprising a through type condenser 19, a first case 20, a second case 21 and a choke coil 23, and disposed adjacent to an input section, acts to prevent certain higher harmonics and fundamental waves generated in the anode cylinder 1 from leaking to the exterior of the magnetron via the filament 2, a center lead 15, a side lead 17 and the input section. To prevent thermions emitted from the filament 2 from escaping out of the active space 4, as shown in FIG. 2, which is an enlargement of area A in FIG. 1, an upper end shield 16 in the form of a frustrum of a circular cone and a lower end shield 18 in the form of a cylinder are brazed to the upper ends of the center and side leads 15, 17, respectively. The upper and lower shields substantially block the upper and lower ends of the active space. To prevent breakage of the filament 2 by an external shock, a spacer 22 made of an insulating material is joined to the center and side leads 15, 17 passing therethrough.

The microwave energy generated by the thermions which effect cycloidal movement in the active space is transferred to the vanes 3. However, some of the thermions escape through the gaps between the upper and lower edges of the vanes 3 and the upper and lower end shields 16, 18 without applying energy to the vanes. Thus, dark current, which is unable to contribute to oscillation of the magnetron, is produced.

Since there is a potential difference of about 4 KV between the upper and lower magnetic poles 9, 10 and the upper and lower end shields 16, 18, the end shield must be positioned exactly in a centered relation within the central openings of the magnetic poles. If uniform clearances between them are not maintained, a spark discharge may occur and cause breakage of the magnetron.

The prior art cathode assembly of the magnetron for the microwave oven is optimally manufactured to have the upper and lower end shields assembled to be exactly centered with respect to the central axis of the anode cylinder, thereby minimizing leakage of thermions out of the active space. However, in practice the upper and lower end shields, which provid support for the filament, are assembled as if they are in a floating condition, as shown in FIG. 2. This means that the upper and lower shields may not be exactly centered Within the magnetic poles, but located eccentrically. As a result, thermions emitted from the filament may escape through wider portions of the gaps between the upper and lower edges of the vanes and the upper and lower end shields, thereby lowering the efficiency of the magnetron.

Since the distances between the upper and lower magnetic poles and the upper and lower end shields, at which a potential difference of 4 KV is provided, may be narrowed to generate a spark, a complicated, troublesome adjustment process of exactly centering the upper and lower end shields about the anode cylinder is required. This process typically entails adjusting the center and side leads in each direction with a jig.

SUMMARY OF THE INVENTION

With the foregoing drawbacks of the prior art in view, it is an object of the present invention to provide a lower end shield assembly of a magnetron. The lower end shield assembly enables the lower end of a filament to be exactly centered with the central axis of an anode cylinder, thereby minimizing the amount of dark current which is unable to contribute to oscillation of the magnetron. The lower end shield assembly also prevents sparks from being generated as a result of contact with the anode cylinder due to an undesirable eccentric alignment of the filament.

To achieve the above object, there is provided according to one embodiment of the present invention, a lower end shield assembly of a magnetron for generating microwaves, comprising a lower end shield having a center through hole for passing a center lead, wherein a flange is provided at a lower portion of the lower end shield; and an insulator supporting the lower end shield with the flange bonded to an upper surface of the insulator, wherein a first support hole is formed in a center portion of the insulator for supporting a center lead, and a second support hole is formed in the insulator for supporting a side lead extending therethrough. In another embodiment of the present invention, the insulator comprises a ring-shaped metallizing portion at the upper surface of the insulator, through which the second support hole is formed.

BRIEF DESCRIPTION OF THE DRAWINGS

The present invention will be better understood by reference to the Description of the Preferred Embodiments when taken together with the attached drawings, wherein.

DESCRIPTION OF THE PREFERRED EMBODIMENT(S)

The invention will now be described in more detail, by way of example, with reference to the accompanying drawings.

Figure 1:
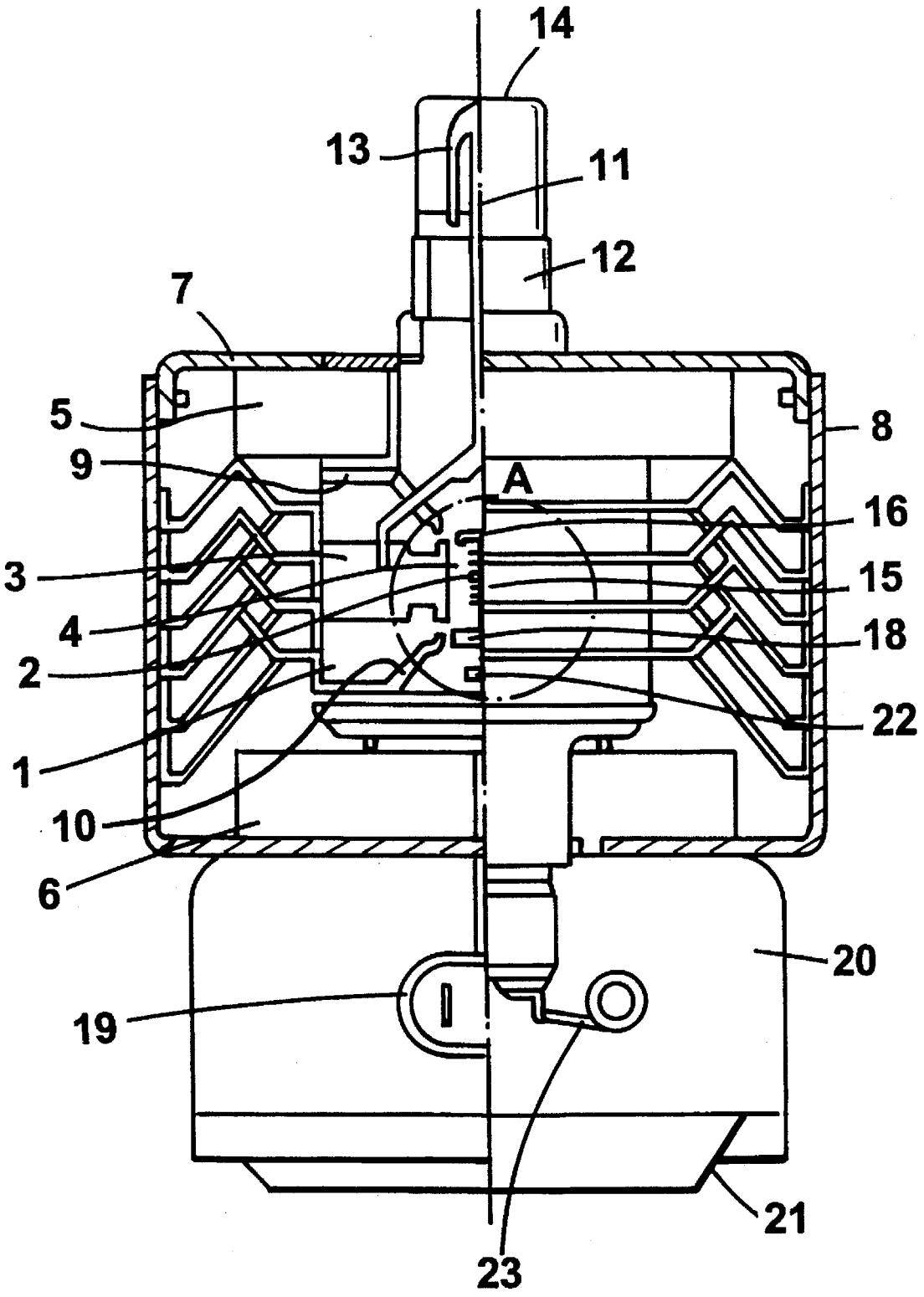
PRIOR ART FIG. 1
FIG. 1 is longitudinal cross-sectional view showing the structure of a conventional magnetron.
Figure 2:
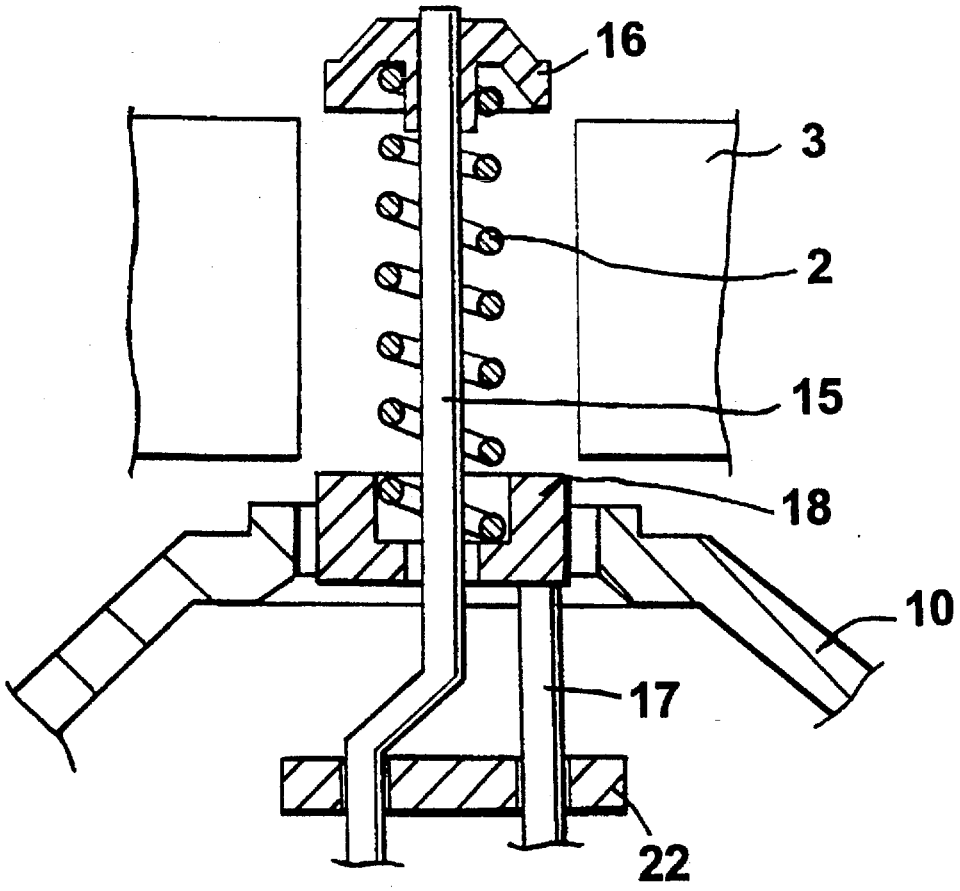
PRIOR ART FIG. 2
FIG. 2 is an enlargement of area A in FIG. 1, showing the structure of a prior art cathode assembly.
Figure 3:
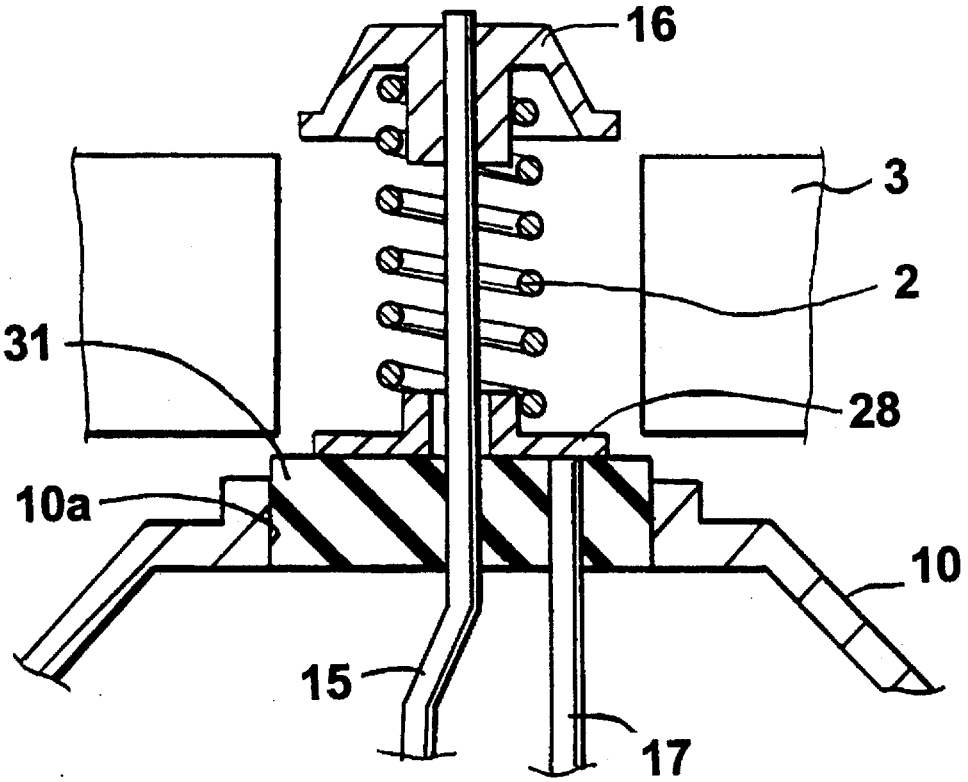
FIG. 3 is a cross-sectional view of a cathode assembly according to the present invention.

Referring to FIG. 3 which shows the structure of a cathode assembly for the magnetron according to the present invention, the essential parts of the magnetron are identical in construction and function with those of the prior art with the exception of the structure of the lower end shield of the cathode assembly. Therefore, throughout the following description, parts similar to those of the prior art are denoted by similar reference numerals. A detailed description of the parts is omitted to avoid duplicate explanation.

Figure 4:
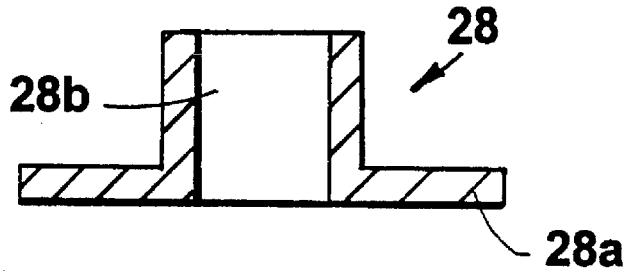
FIGS. 4 and 5 are cross-sectional and perspective views of a lower end shield according to the present invention.
Figure 5:
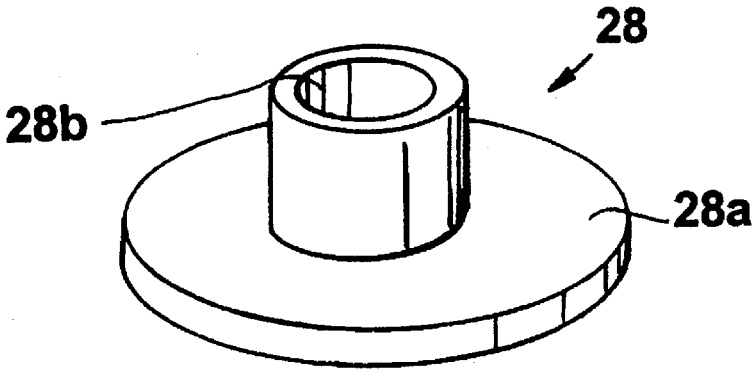

FIGS. 4 and 5 show the lower end shield according to the present invention. The lower end shield 28 is of a general hat shape, which has a flange 28*a* provided at its lower end and a through hole 28*b* formed in the center, through which a center lead 15 passes. A filament 2 with its portion placed over the central cylindrical portion of the end shield is joined to and supported on the flange 28*a*.

The lower end shield 28 is made of a metal having a high melting point, such as molybdenum, and coated with a brazing material having a high melting point, such as Ni—Ru—Mo alloy powder. The filament 2 is bonded to the lower end shield through melting of the brazing material.

Figure 6:
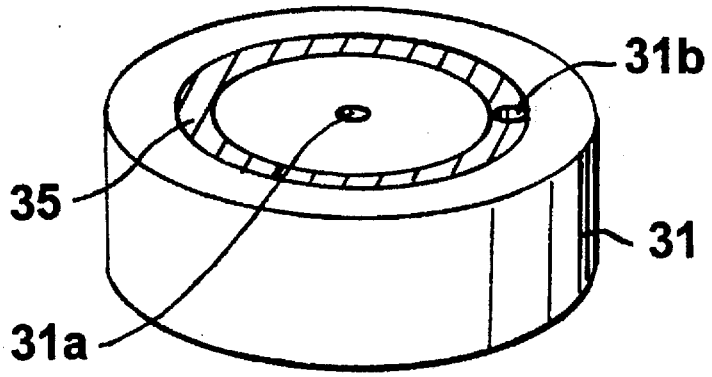
FIGS. 6 and 7 are perspective and cross-sectional views of an insulator for securing the lower end shield according to the present invention.
Figure 7:
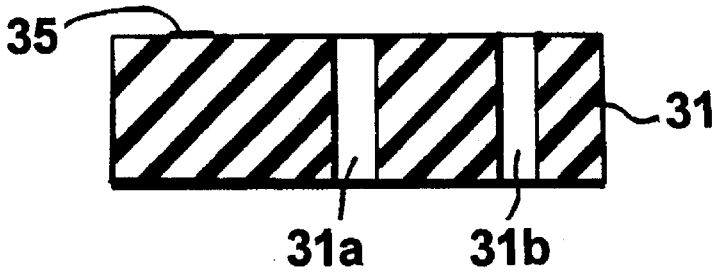

FIGS. 6 and 7 show an insulator for securing the lower end shield 28 according to the present invention. The insulator 31 is made of a ceramic material and is of a disc shape. The insulator is fitted into a central opening 10 a of a lower magnetic pole 10, as shown in FIG. 3. The outer diameter of the insulator 31 has nearly the same size as the diameter of the central opening 10*a* of the lower magnetic pole.

The insulator 31 has a first support hole 31*a* formed in its center and has a size equal to the cross sectional area of the center lead 15. A second support hole 31*b* is formed in a side portion and has a size equal to the cross sectional area of a side lead 17. The center and side leads 15, 17 can be tightly fitted into the support holes 31*a*, 31*b*, respectively.

The insulator 31 can include a ring-shaped metallized portion 35 at its upper surface through which the second support hole 31*b* is formed, as shown in FIG. 6. The metallizing portion 35 serves to bond the lower end shield 28 to the upper surface of the insulator, and at the same time join the side lead 17, which is inserted into the second support hole 31*b* of the insulator, to the lower surface of the lower end shield.

The center lead 15 extends through the central support hole 31*a* of the insulator 31 and passes through the central through hole 28*b* of the lower end shield 28 for coupling to an upper end shield 16, as in the prior art. The filament 2 can be disposed between the upper and lower end shields 16, 28 to effect the same function as that of the prior art.

According to the present invention, since the insulator 31 and the lower end shield 28 can be fixedly mounted in the central opening 10*a* of the lower magnetic pole 10, the lower end shield is exactly centered with the central axis of the anode cylinder. Thus, the gaps between the upper and lower end shields 16, 28 and the upper and lower edges of the vanes 3 may be kept uniform, thereby greatly reducing the amount of dark current which is generated by thermions escaping through the gaps, as compared with the prior art.

From the foregoing it will be appreciated that the present invention allows exact centering of the cathode assembly with respect to the central axis of the anode cylinder to minimize the quantity of thermions escaping from the active space, thereby resulting in enhanced efficiency of the magnetron. Further, the cathode assembly according to the present invention greatly reduces dark current, as discussed above, thereby eliminating adjustment processes which require the use of a jig, and reducing the amount of dark current which is emitted.

Since the insulator can be fixedly mounted to the lower magnetic pole to secure both of the center and side leads, a separate spacer which is required in the prior art to prevent breakage of the filament by external shock may be eliminated. The result is a reduction in manufacturing costs of the magnetron.

While the invention has been shown and described with particular reference to a preferred embodiment thereof, it will be understood that variations and modifications in form and detail may be made therein without departing from the spirit and scope of the invention as defined in the appended claims.

What is claimed is:

1. A cathode assembly of a magnetron for generating microwaves, comprising:

a lower end shield having a center through hole for passing a center lead, wherein a flange is provided at a lower portion of the lower end shield;

a filament in contact with a top portion of the lower end shield; and an insulator supporting said lower end shield with said flange bonded to an upper surface of said insulator, the insulator including a ring-shaped metallized portion at the upper surface of the insulator for serving to bond the lower end shield to the upper surface of the insulator and join a side lead to the lower end shield, a first support hole formed in a center portion of the insulator for receiving a center lead, and a second support hole formed through the ring-shaped metallized portion for receiving the side lead.

2. A cathode assembly of a magnetron for generating microwaves as claimed in claim 1, wherein said filament surrounds a top portion of said lower end shield and a portion of said center through hole.

3. A cathode assembly of a magnetron for generating microwaves as in claim 2, wherein an upper end shield is positioned in contact with said filament and positioned for being joined to said center lead passing through said center through hole.

4. A cathode assembly of a magnetron for generating microwaves as in claim 1 further comprising a lower magnetic pole of a magnetron having an opening, wherein said insulator is mounted in an opening in the lower magnetic pole.

5. A cathode assembly of a magnetron for generating microwaves as in claim 4 further comprising a lower magnetic pole of a magnetron having an opening, wherein said insulator is securely mounted in the opening in the lower magnetic pole.

* * * * *